US012318054B2

(12) United States Patent
Wahlberg

(10) Patent No.: US 12,318,054 B2
(45) Date of Patent: Jun. 3, 2025

(54) DISHWASHER GOODS DRYING SYSTEM

(71) Applicant: Electrolux Appliances Aktiebolag, Stockholm (SE)

(72) Inventor: Magnus Wahlberg, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 900 days.

(21) Appl. No.: 17/276,662

(22) PCT Filed: Sep. 20, 2018

(86) PCT No.: PCT/EP2018/075461
§ 371 (c)(1),
(2) Date: Mar. 16, 2021

(87) PCT Pub. No.: WO2020/057745
PCT Pub. Date: Mar. 26, 2020

(65) Prior Publication Data

US 2021/0267433 A1 Sep. 2, 2021

(51) Int. Cl.
*A47L 15/48* (2006.01)

(52) U.S. Cl.
CPC ..... *A47L 15/488* (2013.01); *A47L 15/486* (2013.01)

(58) Field of Classification Search
CPC ..... A47L 15/488; A47L 15/486
See application file for complete search history.

(56) References Cited

U.S. PATENT DOCUMENTS

| | | | |
|---|---|---|---|
| 3,026,628 | A | 3/1962 | Berger, Sr. et al. |
| 3,175,565 | A | 3/1965 | Dawson |
| 3,241,563 | A | 3/1966 | Braden |
| 3,397,708 | A | 8/1968 | Braden |

(Continued)

FOREIGN PATENT DOCUMENTS

| | | | |
|---|---|---|---|
| CN | 104083136 | A | 10/2014 |
| DE | 3418304 | A1 | 11/1985 |

(Continued)

OTHER PUBLICATIONS

International Search Report and Written Opinion for International Application No. PCT/EP2018/075461, dated May 23, 2019, 13 pages.

*Primary Examiner* — Jessica Yuen
(74) *Attorney, Agent, or Firm* — Bradley Arant Boult Cummings LLP

(57) ABSTRACT

A dishwasher comprising a goods drying system with an ejector at a bottom section of the dishwasher and configured to draw, via a first ejector channel arranged inside the dishwasher, goods drying air in a tub of the dishwasher to an outlet of the ejector where air exits the dishwasher. The drying air enters the first ejector channel at a top section of the dishwasher. A device at an opening of a second channel of the ejector draws air from outside the dishwasher into the second ejector channel to enable the transport of the goods drying air via the first ejector channel. Air drawn from the outside the dishwasher by the device exits via the ejector outlet. Air enters the tub of the dishwasher by an inlet at a bottom of the dishwasher and mixes with the goods drying air in the tub before entering the first ejector channel.

16 Claims, 3 Drawing Sheets

(56) References Cited

U.S. PATENT DOCUMENTS

| | | | | |
|---|---|---|---|---|
| 3,807,420 | A * | 4/1974 | Donselman | A47L 15/486 34/68 |
| 3,908,681 | A | 9/1975 | Schimke et al. | |
| 4,247,158 | A | 1/1981 | Quayle | |
| 5,076,306 | A | 12/1991 | Suzuki et al. | |
| 5,947,135 | A | 9/1999 | Sumida et al. | |
| 6,578,591 | B1 | 6/2003 | Eksert et al. | |
| 6,694,990 | B2 | 2/2004 | Spanyer et al. | |
| 7,093,604 | B2 | 8/2006 | Jung et al. | |
| 7,389,782 | B2 | 6/2008 | Jung et al. | |
| 7,604,014 | B2 | 10/2009 | Paintner | |
| 7,767,029 | B2 | 8/2010 | Lee | |
| 7,798,157 | B2 | 9/2010 | Kim | |
| 7,909,939 | B2 | 3/2011 | Brewer et al. | |
| 8,091,569 | B2 | 1/2012 | Jeong | |
| 8,161,986 | B2 | 4/2012 | Alessandrelli | |
| 8,291,922 | B2 | 10/2012 | Han et al. | |
| 8,303,728 | B2 | 11/2012 | Peukert et al. | |
| 8,409,361 | B2 | 4/2013 | Kim et al. | |
| 8,696,824 | B2 | 4/2014 | Jadhav et al. | |
| 8,734,592 | B2 | 5/2014 | Jerg et al. | |
| 8,757,179 | B2 | 6/2014 | Wetzel et al. | |
| 8,758,525 | B2 | 6/2014 | Kim | |
| 8,887,742 | B2 | 11/2014 | Eiermann et al. | |
| 9,034,112 | B2 | 5/2015 | Tuller et al. | |
| 9,186,037 | B2 | 11/2015 | Jerg et al. | |
| 9,364,134 | B2 | 6/2016 | Kim | |
| 9,480,388 | B2 | 11/2016 | Hong et al. | |
| 9,510,725 | B2 | 12/2016 | Lee et al. | |
| 9,510,728 | B2 | 12/2016 | Tuller | |
| 9,532,700 | B2 | 1/2017 | Welch | |
| 9,635,997 | B2 | 5/2017 | Lee et al. | |
| 9,833,120 | B2 | 12/2017 | Vallejo Noriega et al. | |
| 9,888,829 | B1 | 2/2018 | Bongivengo | |
| 9,907,450 | B2 | 3/2018 | Jadhav et al. | |
| 9,907,451 | B2 | 3/2018 | Wu et al. | |
| 9,943,211 | B2 * | 4/2018 | Noriega | A47L 15/22 |
| 10,024,561 | B2 | 7/2018 | Olson | |
| 10,064,537 | B2 | 9/2018 | Welch | |
| 10,295,256 | B2 | 5/2019 | Jadhav et al. | |
| 10,568,487 | B2 | 2/2020 | Hong et al. | |
| 10,575,708 | B2 | 3/2020 | Thiyagarajan | |
| 10,595,706 | B2 | 3/2020 | Vallejo Noriega | |
| 10,849,481 | B2 | 12/2020 | Hofmann et al. | |
| 10,863,882 | B2 | 12/2020 | Olesen et al. | |
| 11,134,827 | B2 | 10/2021 | Yoon et al. | |
| 2005/0022847 | A1 | 2/2005 | Nito et al. | |
| 2005/0028850 | A1 | 2/2005 | Nito et al. | |
| 2005/0126601 | A1 | 6/2005 | Jung et al. | |
| 2006/0236556 | A1 | 10/2006 | Ferguson et al. | |
| 2008/0005926 | A1 | 1/2008 | Goggin | |
| 2008/0264455 | A1 | 10/2008 | Brewer et al. | |
| 2008/0264458 | A1 | 10/2008 | Berner et al. | |
| 2012/0298146 | A1 | 11/2012 | Padtberg et al. | |
| 2014/0360534 | A1 | 12/2014 | Olson et al. | |
| 2019/0239717 | A1 | 8/2019 | Yoon et al. | |
| 2020/0077867 | A1 * | 3/2020 | Thiyagarajan | F28D 15/0275 |
| 2020/0100644 | A1 | 4/2020 | Kopera | |
| 2021/0186299 | A1 | 6/2021 | Kim et al. | |
| 2021/0353125 | A1 | 11/2021 | Park | |
| 2021/0386268 | A1 | 12/2021 | Sing et al. | |

FOREIGN PATENT DOCUMENTS

| | | | |
|---|---|---|---|
| DE | 4230576 | A1 | 3/1994 |
| EP | 1825800 | A2 | 8/2007 |
| JP | 2000166847 | A | 6/2000 |
| WO | 2014169704 | A1 | 10/2014 |
| WO | 2020074176 | A1 | 4/2020 |
| WO | 2020074294 | A1 | 4/2020 |
| WO | 2020094295 | A1 | 5/2020 |

* cited by examiner

DISHWASHER GOODS DRYING SYSTEM

This application is a U.S. National Phase application of PCT International Application No. PCT/EP2018/075461, filed Sep. 20, 2018, which is incorporated by reference herein.

TECHNICAL FIELD

The invention relates to a dishwasher comprising a goods drying system.

BACKGROUND

A common prior art method for drying goods, such as plates, cutlery, glassware, kitchen utensils, etc., in dishwashers is by increasing heat of rinse water as much as possible and then have the water pour off and slowly evaporate.

The evaporation may be assisted with a fan that causes exhaustion of the humid air and/or a dishwasher door opener that opens the door in order to ventilate steam.

A problem associated with this method of drying the goods is that it causes condensation when the hot humid air exits the dishwasher and contacts outside surfaces which are colder, such as worktops, adjacent cupboards or even the floor due to a too high moist content in the hot and humid air. Any such condensation may eventually damage these surfaces.

SUMMARY

An objective of the invention is to solve, or at least mitigate, this problem in the art, and thus to provide an improved goods-drying system for a dishwasher.

This object is attained accord to the invention by a dishwasher comprising a goods drying system. The system comprises an ejector arranged at a bottom section of the dishwasher and configured to draw, via a first ejector channel arranged inside the dishwasher, goods drying air in a dishwasher tub to an outlet of the ejector where air exits the dishwasher, the goods drying air entering the first ejector channel at a top section of the dishwasher, a device arranged at an opening of a second channel of the ejector and configured to draw air from outside the dishwasher into the second ejector channel o enable the transport of the goods drying air via the first ejector channel, which air drawn from the outside of the dishwasher by the device exits via the ejector outlet, and an air inlet arranged at the bottom section of the dishwasher via which air from outside the dishwasher is configured to enter into the tub of the dishwasher and mix with the goods drying air in the tub before entering the first ejector channel.

Thus, the ejector comprises a first channel extending into the tub and being configured to transport the air which is entered via the air inlet and mixed with the hot and humid drying air in the tub to an outlet of the ejector where air exits the dishwasher. The mixed air enters the first ejector channel at a top section of the dishwasher.

This transport of air is accomplished by a device such as a fan drawing cool and dry ambient air into a second channel of the ejector. A difference in pressure between the cool and dry ambient air and the hot and humid goods drying air will cause the goods drying air, and the air drawn into the tub via the air inlet, to be drawn into the ejector via the first ejector channel extending from the top section to the bottom section of the tub, where the hot and humid goods drying air will mix with the cool and dry ambient air drawn by the fan.

The mixed air will then leave the dishwasher via an ejector outlet. This air is far cooler and drier than the hot and humid goods drying air. For instance, the rate of the airflow drawn by the fan is, say, four or five times greater than that of the airflow drawn via the first ejector channel.

Advantageously, the hot and humid air inside the tub caused by the drying of the goods will have a temperature upon being exhausted from the dishwasher which is just slightly above room temperature. Hence, the risk of condensation occurring during exhaustion of air after the goods have been dried is practically eliminated.

In an embodiment, the ejector is configured such that a flowrate of the air drawn by the fan into the second ejector channel is at least equal to the flowrate of the air drawn into the ejector via the first ejector channel, or more preferable three times that of the flowrate of the air drawn into the first ejector channel, or even more preferable five times that of the flowrate of the air drawn into the first ejector channel.

In a further embodiment, the air drawn by the fan from outside the dishwasher into the second ejector channel has a temperature being less than 20% of the temperature of the goods drying air in the tub, or more preferable less than 40% of the temperature of the goods drying air in the tub, or even more preferable less than 50% of the temperature of the goods drying air in the tub.

In an embodiment, the first ejector channel transporting the goods drying air is arranged to end inside the ejector facing the ejector outlet, wherein the air drawn into the second ejector channel will pass along an outer periphery of an end of the first channel inside the ejector and exit via the ejector outlet where the air drawn into the second ejector channel from outside the dishwasher mixes with the goods drying air drawn into the first ejector channel.

In an embodiment, the second ejector channel and the ejector outlet are both arranged along a longitudinal axis of the ejector.

In an embodiment, a first section of the first ejector channel extending into the tub of the dishwasher is arranged transversally to a longitudinal axis of the ejector, while a second section of the first ejector channel facing the ejector outlet is arranged along a longitudinal axis of the ejector.

In an embodiment, the air inlet is arranged at a bottom section of the dishwasher while an opening of the first channel of the ejector is arranged at a top section of the dishwasher such that the air being drawn into the first air inlet travels along a diagonal of the tub of the dishwasher (20) to the first channel of the ejector.

Further embodiments will be discussed in the following.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
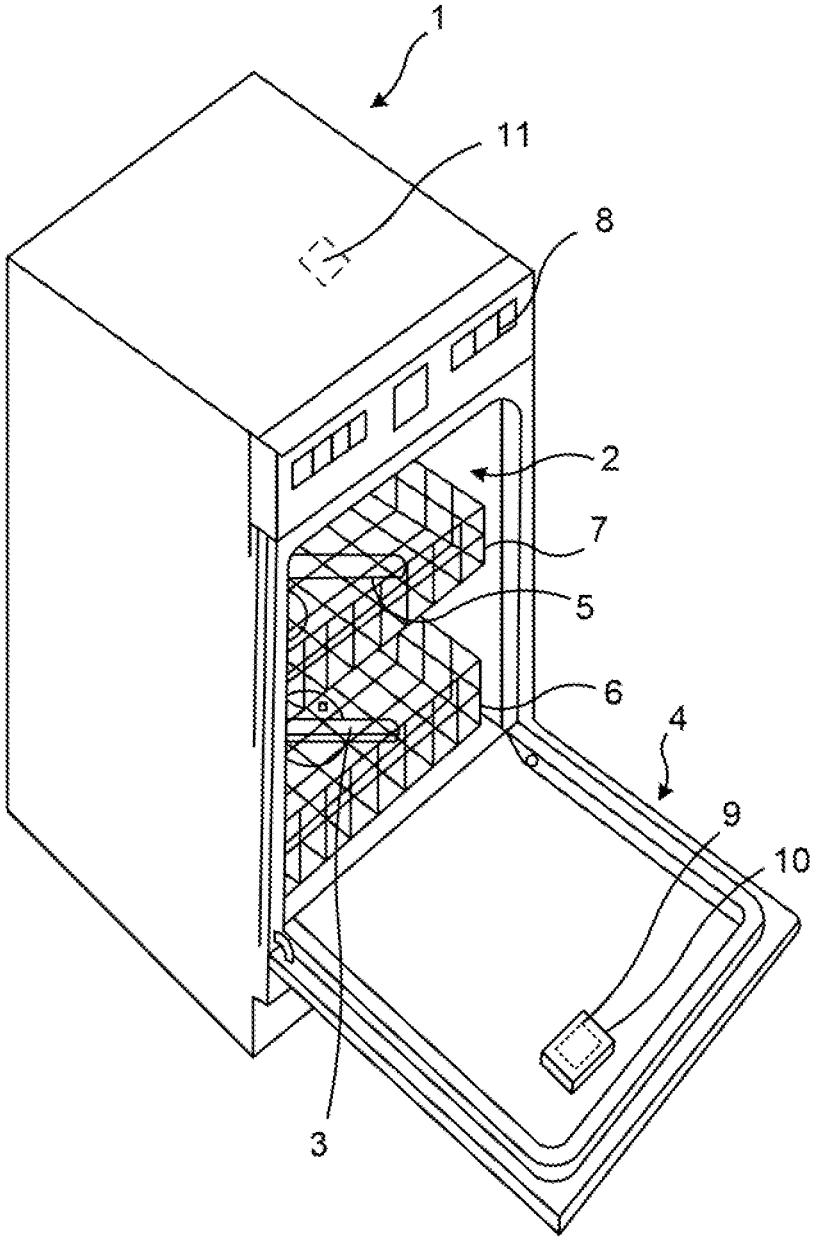
FIG. 1 shows a prior art dishwasher in which the present invention may be implemented.

FIG. 1 shows a prior art appliance for washing and rinsing goods in the form of a dishwasher 1 in which the present invention can be implemented. It should be noted that dishwashers can take on many forms and include many different functionalities. The dishwasher 1 illustrated in FIG. 1 is thus used to give an example of a basic prior art dishwasher in which the present application can be applied.

The exemplifying dishwasher 1 comprises a washing compartment or tub 2, a door 4 configured to close and seal the washing tub 2, a spraying system having a lower wash arm 3 and an upper wash arm 5, a lower rack 6 and an upper rack 7. Additionally, it may comprise a specific top rack for cutlery (not shown). A controller 11 such as a microprocessor is arranged in an interior of the dishwasher for controlling washing programmes and is communicatively connected to a user interface 8 via which a user can select washing programmes. The operation of the dishwasher 1 is typically controlled by the controller 11 executing appropriate software stored in a memory.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the washing compartment 2.

As previously has been discussed, upon the dishwasher 1 finishing a selected cleaning programme, the door 4 is typically opened such that the hot and humid air inside the tub 2 is exhausted, which hot and humid air may cause undesired condensation and eventually even damage the surfaces it contacts.

Figure 2:
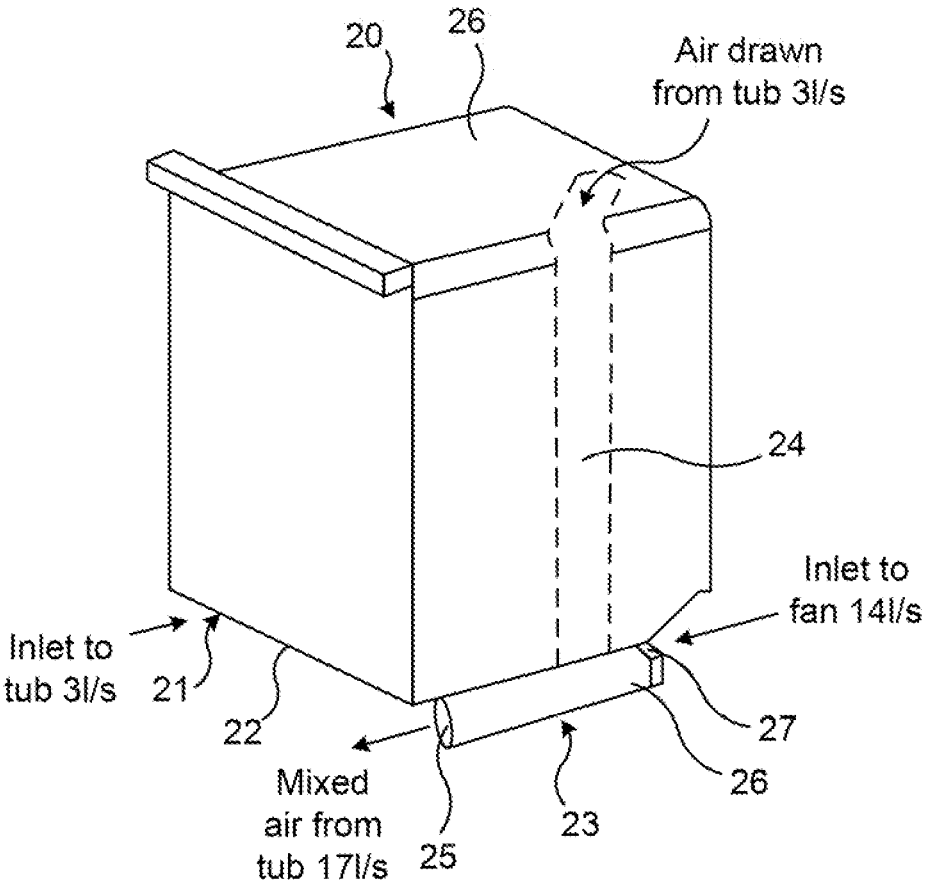
FIG. 2 illustrates a dishwasher implementing a goods drying system according to an embodiment of the invention.

FIG. 2 illustrates a dishwasher 20 implementing a goods drying system according to an embodiment of the invention.

The goods drying system comprises an air inlet 21 arranged at a bottom section 22 of the dishwasher 20 via which cold air is entered into the tub of the dishwasher. In this context, "cold" air should be construed as air having a lower temperature than the hot and humid air drying the goods inside the tub of the dishwasher 20. Preferably, the air entered via the air inlet 21 has a considerably lower temperature than the goods drying air in the tub, such as half the temperature of the goods drying air. In practice, the air entering the air inlet 21 constitutes the ambient air surrounding the dishwasher 20.

For example, the air entered via the air inlet 21 air holds a temperature around 25° C. and a humidity of about 35% (depending on surrounding climate), while the hot and humid drying air inside the tub has a temperature of, say, 50° C. and a humidity close to 100%.

The goods drying system further comprises an ejector 23 which also is arranged at the bottom section 22 of the dishwasher 20.

As can be seen in FIG. 2, the ejector 23 comprises a first channel 24 configured to transport the air entered via the air inlet 21 mixed with the hot and humid drying air in the tub to an outlet 25 of the ejector 23 where air exits the dishwasher 20. The mixed air enters the first ejector channel 24 at a top section 26 of the dishwasher 20. In the embodiment shown in FIG. 2, the air inlet 21 is arranged at a bottom left front section of the dishwasher 20 while an opening of the first channel 24 of the ejector 23 is arranged at a top right rear section of the dishwasher, thereby creating an air flow path inside the tub extending physically over a diagonal of the tub. This is optional, but has as an advantage that the longer the air flow path, the greater amount of humid air will be transported from the air inlet 21 to the opening of the first ejector channel 24.

Further, even if the air drawn in via air outlet 21 would not travel over the diagonal of the tub, it is still advantageous to have the air inlet arranged at a bottom section of the dishwasher and the first ejector channel inlet at a top section of the dishwasher 20, since the cold air ambient is warmed up, rises, and transports moisture of the warm air in the tub to the first ejector channel 24.

Alternatively, the air inlet 21 is arranged at a bottom right front section of the dishwasher 20 while an opening of the first channel 24 of the ejector 23 is arranged at a top left rear section of the dishwasher, again creating an air flow path inside the tub extending physically over a diagonal of the tub.

The ejector 23 further comprises a second channel 26 having an opening facing a rear end of the dishwasher 20. At the opening of the second ejector channel 26, a fan 27 is arranged for drawing cold and dry ambient air into the second channel 26. In an example, an air flow of about 14 l/s is entered into the second channel 26 of the ejector 23, and the ambient air is again assumed to hold a temperature around 25° C. and a humidity of about 35%.

The design of the ejector 23 (which will be discussed in more the detail in the following) determines a magnitude of the flow of the goods drying air being drawn into the first ejector channel 24. For instance, the greater the flow being entered into the second channel 26, the greater the flow being drawn into the first channel 24.

In this particular exemplifying embodiment, the air flow of 14 l/s caused via the second ejector channel 26 by the fan 27 will result in an air flow of about 3 l/s being drawn into the first ejector channel 24, which accordingly will be the magnitude of the air flow being drawn into the first air inlet 21.

Hence, in the following, the air entered via the second ejector channel will have a flow rate of 14 l/s, while the air drawn into the air inlet 21 and the first ejector channel 24 will be 3 l/s. Alternatively, a compressor or a blower may be used to draw air from outside the dishwasher 20 into the second ejector channel 26. An advantage in drawing dry air from outside the dishwasher 20 is that no condensation occurs in the fan 27.

Figure 3:
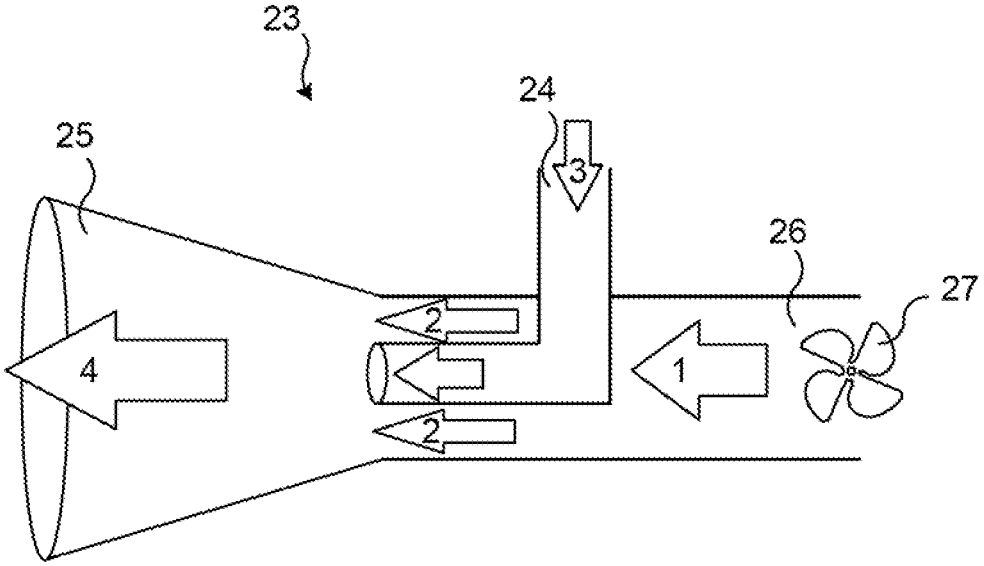
FIG. 3 illustrates an ejector included in the goods drying system according to an embodiment in a sectional side view.

With reference to FIG. 3, illustrating the ejector 23 in a sectional side view, a first air flow (1) is drawn by the fan 27 into the second ejector channel 26. This is relatively cool and dry ambient air having high static pressure and low dynamic pressure.

The first air flow (1) will pass along an outer periphery of the first channel 24 inside the ejector 23 and exit via the ejector outlet 25. This will give rise to a second air flow (2) surrounding the first channel 24, having the same flow rate as the first air flow (1), but a higher dynamic pressure and a lower static pressure.

The lower static pressure of the second air flow (2) will cause a difference in pressure between the second air flow (2) and a third air flow (3) being drawn into the first ejector channel 24, i.e. the hot and humid goods drying air. This difference in pressure, i.e. under pressure, causes the goods drying air to be drawn into the first ejector channel 24.

Finally, the second air flow (2) and the third air flow (3) is mixed at the ejector outlet 25, resulting in a fourth air flow (4) having a considerably lower temperature and humidity than the goods drying air.

The air being exhausted via the ejector outlet 25 will thus, in this exemplifying embodiment, have a flow rate of 17 l/s and a temperature of:

$$T=(50\times3/17)+(25\times14/17)\approx29^\circ\text{ C.} \quad (1)$$

and correspondingly a humidity of about 46% (assuming that the ambient air has a humidity of 35% while the goods drying air has a humidity of 100%).

Advantageously, the hot and humid air inside the tub caused by the drying of the goods will have a temperature of about 29° C. upon being exhausted from the dishwasher 20, which is just slightly above room temperature. Hence, the risk of condensation occurring during exhaustion of air after the goods have been dried is practically eliminated.

Now, should the temperature of the ambient air drawn by the fan 27 into the second ejector channel 26 be 20° C., the temperature of the air being exhausted via the ejector outlet 25 would be just above 25° C.

As can be concluded, the temperature of the air being exhausted via the ejector outlet 25 is mainly controlled by the temperature and flowrate of the air drawn by the fan 27 into the ejector 23, as well as an ejector design which affects the magnitude of the air flow in the first ejector channel 24. The flowrate of the air drawn by the fan 27 into the ejector 23 is dependent on the capacity of the fan 27, while the temperature of the air drawn by the fan 27 into the ejector 23 mainly is dependent on the ambient temperature of the dishwasher 20 (unless some cooling means is used).

In a practical case, the ejector 23 should be designed such that flowrate of the air drawn by the fan 27 into the second ejector channel 26 should be at least equal to the flowrate of the air drawn via the first ejector channel 24, but preferably 3-5 times higher.

For example, if the space between the interior of the second ejector channel 26 and the exterior of first ejector channel 24 decreases—i.e. by either increasing the diameter of the first ejector channel 24 or by decreasing the diameter of the second ejector channel 26—the pressure difference between the second air flow (2) and the third air flow (3) will increase and the flowrate of the air drawn via the first ejector channel 24 will also increase.

Further, the flowrate of the air drawn via the first ejector channel 24 may be increased by increasing the flow and/or pressure of the fan 27.

It is noted that the ejector outlet 25 not necessarily will have an increasing diameter in the direction of the air flowing out of the outlet 25, but may in an embodiment alternatively be tapered such that the diameter decreases in the direction of air flow being output.

Further in a practical case, the temperature of air drawn by the fan 27 into the second ejector channel 26 should be lower than the temperature of the goods drying air, such as 20% lower, but preferably 40-60% lower.

With reference again to FIG. 3, the second ejector channel 26 and the ejector outlet 25 are both arranged along a longitudinal axis of the ejector 23.

Further with reference to FIG. 3, a first section of the first ejector channel 24 extending into the tub of the dishwasher 20 is arranged transversally to a longitudinal axis of the ejector 23 (or substantially transversal to the longitudinal axis of the ejector 23), while a second section of the first ejector channel 24 facing the ejector outlet 25, i.e. the section where the first air flow (1) passes along an outer periphery of the first ejector channel 24, is arranged along a longitudinal axis of the ejector 23.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A dishwasher comprising a goods drying system, the dishwasher comprising:

an ejector arranged at a bottom section of the dishwasher and configured to draw, via a first ejector channel arranged inside the dishwasher, goods drying air in a tub of the dishwasher to an outlet of the ejector where air exits the dishwasher, the goods drying air entering the first ejector channel at an opening arranged at a top rear section of the dishwasher;

a device arranged at an opening of a second channel of the ejector and configured to draw air from outside the dishwasher into the second ejector channel to enable the transport of the goods drying air via the first ejector channel, which air drawn from the outside of the dishwasher by the device exits via the ejector outlet; and an air inlet arranged at a bottom front section of the dishwasher via which air from outside the dishwasher is configured to enter into the tub of the dishwasher and mix with the goods drying air in the tub before entering the first ejector channel, wherein the air inlet and the opening of the first channel of the ejector are arranged on opposite sides of the dishwasher such that the air being drawn into the air inlet travels upwardly along a diagonal of the tub of the dishwasher to the first ejector channel, and wherein the first ejector channel extends continuously from a first end positioned at the opening arranged at the top rear section of the dishwasher to a second end arranged inside the ejector and facing the ejector outlet, wherein the air drawn into the second ejector channel is configured to pass along an outer periphery of the second end of the first ejector channel and exit via the ejector outlet where the air drawn into the second ejector channel from outside the dishwasher mixes with the goods drying air drawn into the first ejector channel.

2. The dishwasher of claim 1, wherein the device configured to draw air from outside the dishwasher into the second ejector channel comprises one of: a fan, a compressor and a blower.

3. The dishwasher of claim 1, wherein the ejector is configured such that a flowrate of the air drawn by the device into the second ejector channel is at least equal to or greater than the flowrate of the air drawn into the ejector via the first ejector channel.

4. The dishwasher of claim 1, wherein the air drawn into the second ejector channel has a temperature less than 20% of a temperature of the goods drying air in the tub.

5. The dishwasher of claim 1, wherein the second ejector channel and the ejector outlet both are arranged along a longitudinal axis of the ejector.

6. The dishwasher of claim 1, wherein a first section of the first ejector channel extending into the tub of the dishwasher is arranged transversally to a longitudinal axis of the ejector, while a second section of the first ejector channel facing the ejector outlet is arranged along the longitudinal axis of the ejector.

7. The dishwasher of claim 1, wherein the ejector is configured such that a flowrate of the air drawn by the device into the second ejector channel is at least equal to or greater than three times a flowrate of the air drawn into the ejector via the first ejector channel.

8. The dishwasher of claim 1, wherein the ejector is configured such that a flowrate of the air drawn by the device into the second ejector channel is about five times a flowrate of the air drawn into the ejector via the first ejector channel.

9. The dishwasher of claim 1, wherein the air drawn into the second ejector channel has a temperature less than 40% of a temperature of the goods drying air in the tub.

10. The dishwasher of claim 1, wherein the air drawn into the second ejector channel has a temperature less than 50% of a temperature of the goods drying air in the tub.

11. A dishwasher comprising:

an ejector arranged at a bottom section of the dishwasher and configured to draw, via a first ejector channel arranged inside the dishwasher, goods drying air in a tub of the dishwasher to an outlet of the ejector where air exits the dishwasher, the goods drying air entering the first ejector channel at an opening arranged at a top rear section of the dishwasher;

a device arranged at an opening of a second channel of the ejector and configured to draw air from outside the dishwasher into the second ejector channel to enable the transport of the goods drying air via the first ejector channel;

an air inlet arranged at a bottom front section of the dishwasher, wherein the air inlet and the opening of the first channel of the ejector are arranged on opposite sides of the dishwasher such that air being drawn into the air inlet travels upwardly along a diagonal of the tub of the dishwasher to the first ejector channel, and wherein the first ejector channel comprises a first end positioned at the opening arranged at the top rear section of the dishwasher and a second end arranged inside the ejector and facing the ejector outlet and the first ejector channel extends continuously from the first end to the second end, wherein the air drawn into the second ejector channel is configured to pass along an outer periphery of the second end of the first ejector channel and exit via the ejector outlet where the air drawn into the second ejector channel from outside the dishwasher mixes with the goods drying air drawn into the first ejector channel.

12. The dishwasher of claim 11, wherein the device is a fan or a compressor.

13. The dishwasher of claim 11, wherein the ejector is configured such that a flowrate of the air drawn by the device into the second ejector channel is at least equal to or greater than the flowrate of the air drawn into the ejector via the first ejector channel.

14. The dishwasher of claim 11, wherein a first section of the first ejector channel extending into the tub of the dishwasher is arranged transversally to a longitudinal axis of the ejector, while a second section of the first ejector channel facing the ejector outlet is arranged along the longitudinal axis of the ejector.

15. The dishwasher of claim 11, wherein the ejector is configured such that a flowrate of the air drawn by the device into the second ejector channel is at least equal to or greater than three times a flowrate of the air drawn into the ejector via the first ejector channel.

16. The dishwasher of claim 11, wherein the second ejector channel and the ejector outlet both are arranged along a longitudinal axis of the ejector.

* * * * *